United States Patent [19]

Brock et al.

[11] 3,967,544

[45] July 6, 1976

[54] GROCERY SACK PROCESS AND MACHINE

[75] Inventors: Herbert Brock, Sheboygan; Glenroy G. Blatz, Kiel, both of Wis.; James B. Honn, Arcola, Ill.

[73] Assignee: National Petro Chemicals Corporation, New York, N.Y.

[22] Filed: Oct. 3, 1974

[21] Appl. No.: 511,836

Related U.S. Application Data

[63] Continuation-in-part of Ser. No. 413,014, Nov. 5, 1973, abandoned.

[30] Foreign Application Priority Data

May 1, 1973 United Kingdom ..... 20676/73

[52] U.S. Cl. ..... 93/35 SB; 93/8 R; 93/14; 93/84 FF

[51] Int. Cl.[2] ..... B31B 33/26

[58] Field of Search ..... 93/35 SB, 35 R, 8 R, 93/14–28, 32, 84 R, 84 FF; 53/384, 385, 386

[56] References Cited

UNITED STATES PATENTS

| | | | |
|---|---|---|---|
| 623,983 | 5/1899 | Claussen et al. | 93/32 X |
| 742,205 | 10/1903 | Lorenz | 93/32 |
| 2,773,435 | 12/1956 | Richens | 93/22 |
| 2,973,697 | 3/1961 | Lerner | 93/84 FF UX |
| 3,260,170 | 7/1966 | Barraclough | 93/32 X |
| 3,466,980 | 9/1969 | Achelpohl | 93/8 R |
| 3,606,822 | 9/1971 | Platz et al. | 93/35 SB |
| 3,618,476 | 11/1971 | Achelpohl | 93/28 X |

*Primary Examiner*—James F. Coan
*Attorney, Agent, or Firm*—Kenneth D. Tremain

[57] ABSTRACT

Apparatus and process for continuously and repetitively producing grocery sacks from a thermoplastic web at high speed, including particularly a folding operation involving applying grasping action to bag blanks formed from a heat sealed gusseted flattened tubular web of, e.g., high density polyethylene at the upper and lower portions thereof, respectively, causing said portions to be forwarded at differential longitudinal speeds whereby a rough folded bag bottom is formed. Preferably, the web is flexed as by introduction of air to the bag blank or sack to release the respective web faces and facilitate folding. A complete apparatus includes sealing, cutting, folding and pressing means and may incorporate printing and like ancillary features.

21 Claims, 18 Drawing Figures

FIG. 15
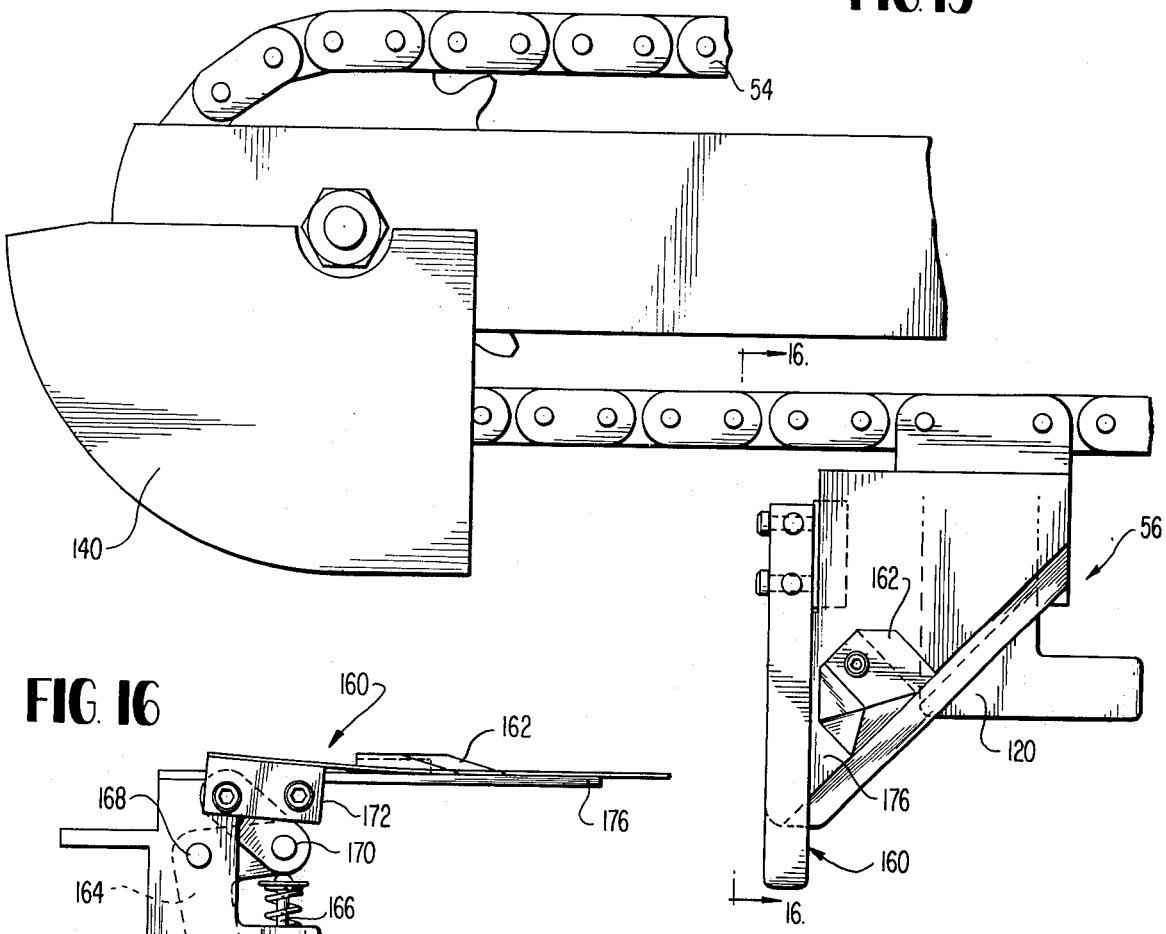
FIG. 16
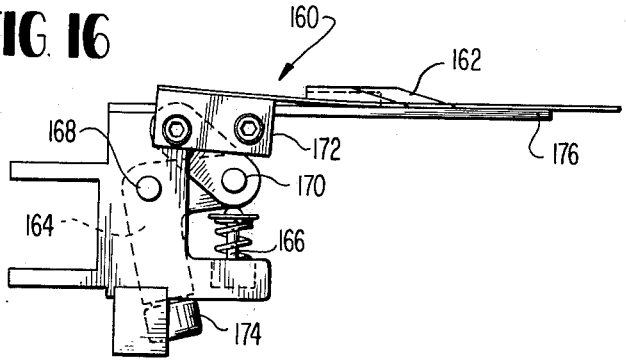
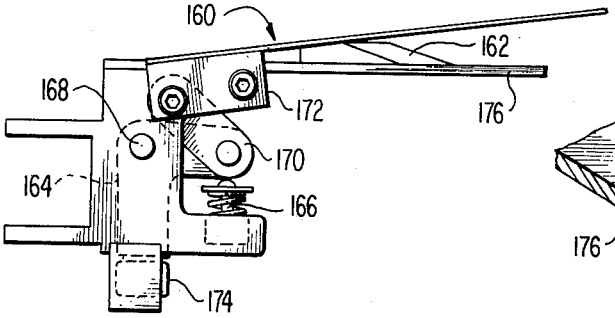
FIG. 17
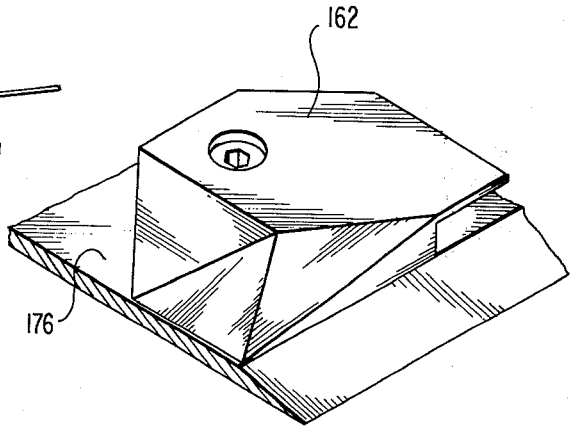
FIG. 18

GROCERY SACK PROCESS AND MACHINE

CROSS REFERENCE

This application is a continuation-in-part of copending application Ser. No. 413,014 filed Nov. 5, 1973, and now abandoned.

BACKGROUND OF THE INVENTION

Grocery sacks of high density polyethylene film (HDPE) are now in the position of an idea whose time has come. Paper grocery sacks are used by the billions, but plastic has significant advantages over paper including greater toughness, ultimate wet strength and moisture resistance, lighter weight, good appearance and excellent reuse potential.

Grocery sacks of HDPE are known and one such sack is shown in U.S. Pat. No. 3,669,347 assigned to the assignee of this application. Another commonly owned U.S. Pat. No. 3,606,822, discloses a method and apparatus for making such a sack. The problem is in rapidly, continuously, and automatically making such sacks as the prior art is substantially a sack-by-sack hand operation which by its nature is slow and consequently uneconomical.

The prior art of making paper bags is ancient and quite well worked, see e.g. U.S. Pat. No. 634,081, but the solutions to problems in making paper sacks including suitable means for folding, sealing, cutting and the like, are not applicable to a similarly constructed bag of plastic such as HDPE due primarily to the differences in the characteristics of the materials. In other words, because HDPE plastic does not seal, cut or fold like paper, machines for making paper bags are presently useless for making sacks or bags of HDPE.

Certain of the advantages offered by thermoplastic materials pose difficulties in bag forming operations, and particularly folding, in that electrostatic effects may tend to maintain a gusseted web in a flattened condition, and flexural properties increase resistance to fold and crease formation, especially where multiple and complex folds are required to be performed within a small region and at high speed.

SUMMARY OF THE INVENTION

This invention is a unique process for automatically and continuously making folded bottom, gusseted grocery sacks from a thermoplastic web. Ordinarily, the web initially constitutes a flattened tube of high density polyethylene film. The web is formed into a gusseted structure, i.e. one having top and bottom walls or faces united along each longitudinal edge by a gusset, being a single inlaid fold. A roll of such material is fed under controlled tension to bag forming operations.

The invention also includes providing of printed sacks wherein the surface of the web under controlled tension is treated to receive printing, the web is then aligned prior to printing, and is printed on. The gusseted web which may or may not contain printing thereon is fed to a sealing, cutting and bottom folding machine constituting a principal aspect of this invention wherein it is carried along by grasping and forwarding means, such as grippers gripping the lower gusset edges. While travelling, the web is periodically transversely sealed by travelling heat seal bars, then cut adjacent the seal, as by a rotary razor blade cutter operating against a soft plastic back-up roll so the plastic cut does not stick together. This provides a series of closely longitudinally spaced bag blanks or sacks closed at one end by the seal. Thereafter, while the individual sacks are still carried on the grippers at the same speed of the web, they may be flexed or opened, as by a stream of air, preferably ionized air, to a predetermined limited amount to separate the top and bottom faces of the web and render the bag blank susceptible to folding operations. The opening action also facilitates the presentation of the upper gusset edge for grasping action in bottom folding. The bottom of each individual sack is then rough folded while the sack is moving by releasably engaging or grasping the upper and lower gussets of each side of the bag blank at common positions adjacent the sealed end of the bag blank. The respective gusset portions are then caused to move at differential longitudinal speeds. Suitably, the sealed edge forms the leading section of the sack, and the gusset portions are grasped with separate sets of moving grippers which travel at differential speeds so that the upper gusset is pulled back behind the lower gusset to create a rough bottom incorporating generally transverse folds and creases adjacent the gripping region. Any air is then removed from the individual sacks and the sacks are flattened or pressed to press in the bottom fold and removed and stacked.

All of the operations are continuous and automatic and synchronized in order to produce sacks or bags at high speed.

BRIEF DESCRIPTION OF THE DRAWINGS

FIG. 15 is a fragmentary enlarged top plan view partly in schematic of a lower gusset gripper means assembly.

FIGS. 16 and 17 are sectional elevation views taken along line 16—16 of FIG. 15, showing two operative positions.

FIG. 18 is an enlarged perspective view showing the spacer of FIG. 15.

DETAILED DESCRIPTION OF THE PREFERRED EMBODIMENT

Figure 1:
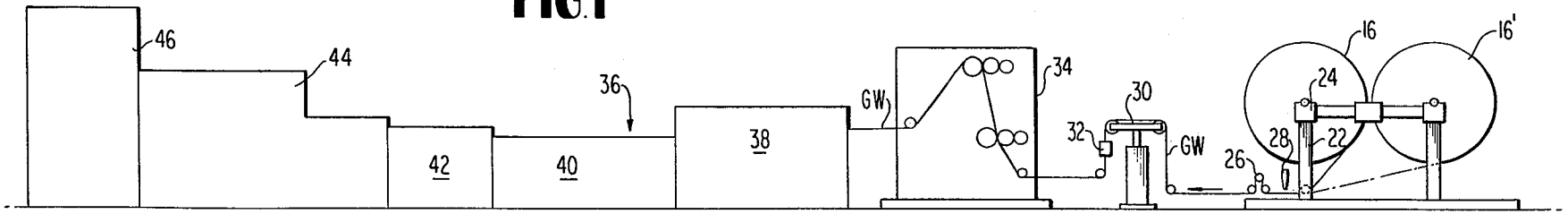
FIG. 1 is a schematic side elevation illustrating generally the components for carrying out the process of this invention.
Figure 12:
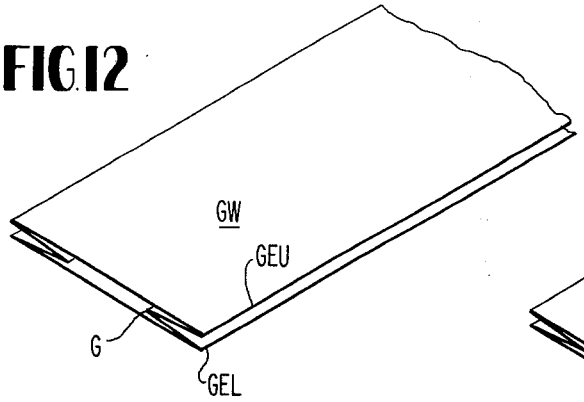
FIGS. 12, 13 and 14 are perspective views showing the gusseted web, the sealed and cut web forming an unfolded sack, and the completed folded bottom sack, respectively.

FIG. 1 illustrates the components for practicing the process of this invention for making a gusseted folded bottom grocery sack from a roll of HDPE in tubular gusseted form such as a gusseted web GW, see FIG. 12. The gusseted web is in the form of a flat web with inwardly extending gussets G as shown in FIG. 12 and is in the form of a roll 16, or rolls 16, 16' supported on a roll stand 22 with brake means 24 for braking the roll shaft and consequently controlling the tension in the web as it is paid out. A tension sensor 26 for the web feeds back to the brake 24 to control the tension in the web at the desired amount.

A preprinting treatment means such as a flame treating burner 28 is positioned to treat one surface of the web to be printed upon. The gusseted web GW is then aligned by an automatic web guide 30 of the pivoted type controlled by edge sensors 32 which sense the position of the edge of the web and feed back to control the guides 30. The web is then printed upon by a suitable printing press 34 and the gusseted printed web GW leaves the printing press and passes directly into a bag making and bottom folding machine 36 constituting the machinery part of this invention. The printing press, web tension control arrangements and other components ahead of the bag making and bottom folding machine are commercially available components which are assembled together as shown.

The bag making and bottom folding machine 36 includes a sealing section 38, a cutting section 40, a bottom folding section 42, which feeds into a collator-stacker 44 adjacent a bundle wrapping and shipping station 46.

Referring now to the bag making and bottom folding machine 36, it is supported on a machine base 48 which can conveniently be a number of separated supports such as legs 50 connected generally across the top by top rail means 52. The gusseted web GW (FIG. 12) is first transformed into the sealed bottom sack (FIG. 13) by sealing and cutting, and then into a folded bottom grocery sack (FIG. 14) by the machine 36. The gusseted web is fed into the machine 36 by overdriven nip rolls 53, which are driven at a speed slightly greater than the speed of the web through the machine in order to remove tension on the heat seals and to compensate for web shrinkage during heat sealing.

The gusseted web, the sealed bottom sack and the folded bottom sack are all carried through the production line continuously, rapidly and at the same speed by gripper means positioned on each side of the gusseted web GW. These gripper means include side gripper chains 54 carrying openable grippers 56 which are guided on to grip the lower gusseted edge GEL (FIG. 12) of the web as it enters the machine at the right hand sides of FIGS. 2 and 3. Spacer fingers 60, or additional grippers at this position, also enter the gusset of the web. The open grippers are guided onto the lower gusseted web GEL by guides 61 so that one clamp of the gripper is inside the gusset and the other is below the web. The guide 61 also opens the gusset G to allow gripper insertion.

Figure 8:
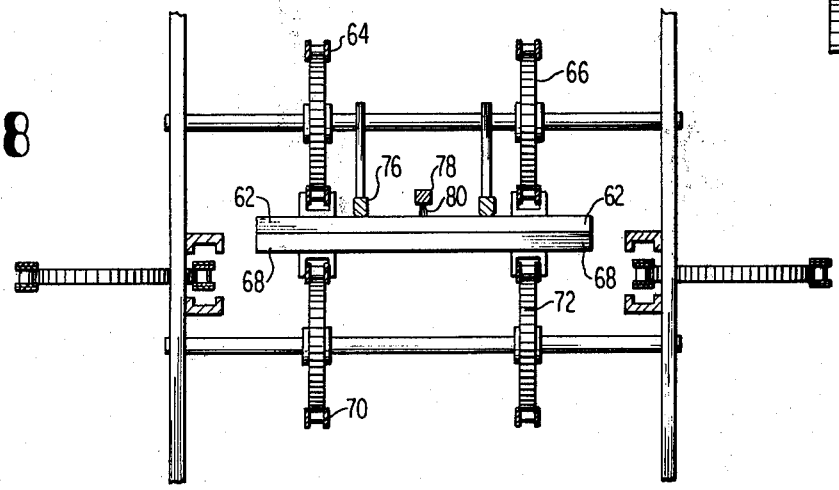
FIG. 8 is a sectional elevation view taken along line 8—8 of FIG. 3 showing web sealing means.

The first step in operating on the gusseted web GW is to transversely seal across the web including the folded gussets while the web is moving and at spaces equal to the length of the desired shape bag or sack. The sealing section 38 accomplishes this sealing with a plurality of transversely extending heat sealing bars 62, FIGS. 2, 3 and 8, carried by a chain 64 trained around sprockets 66 and positioned so that the lower run of the chain carries the bar in contact with the surface of the gusseted web. The sealing section includes lower sealing bars 68, similar to bars 62, which are carried by chains 70, trained around sprockets 72 and driven in synchronism with chains 64. The chains are driven so that the bars travel at substantially the speed of the gusseted web. The sprockets and chains in the sealing mechanism are supported from a superstructure 74 which also supports electrical apparatus (not shown) for applying electrical impulses to either one or both sets of the sealing bars for impulse sealing. The sealing bars 62 and 68 are positioned on the chain so that they coincide to grip the gusseted web between them, see FIGS. 2 and 8. In order to apply the correct pressure during heat sealing, a pair of adjustable pressing bars 76 are positioned behind at least the top heat sealing bars 62 in order to positively control the position and pressure of these heat sealing bars. Each of the heat sealing bars 62 carries a heatable portion on its outer surface to contact the gusseted web along the area to be sealed. Electrical power for heating the area to be sealed is supplied from a sectionalized bus bar 78, FIG. 8, positioned between the pressing bar 76 which is contacted by brushes 80 carried by the heat sealing bars 62, eg., for electrical impulse sealing.

Figure 2:
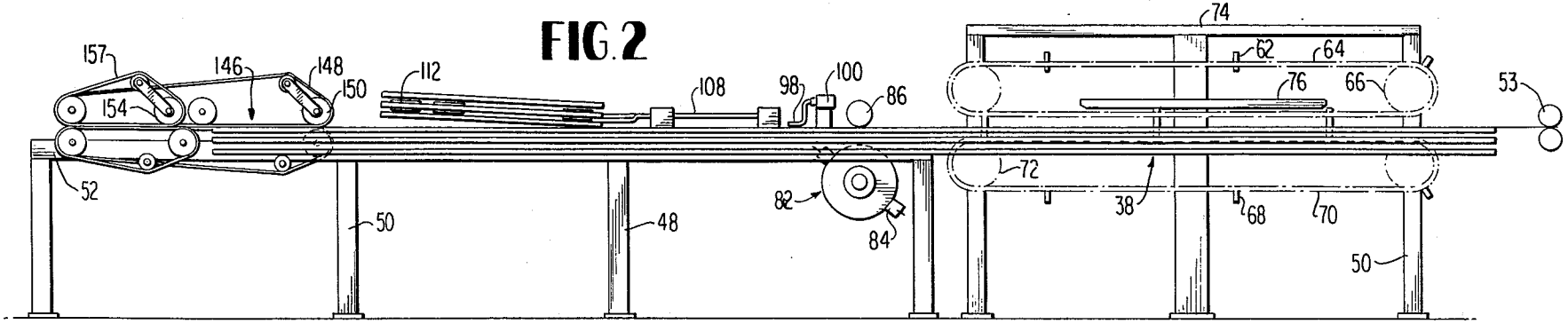
FIG. 2 is a side elevation of the sack sealing, cutting and bottom folding machine for making the grocery sack.
Figure 7:
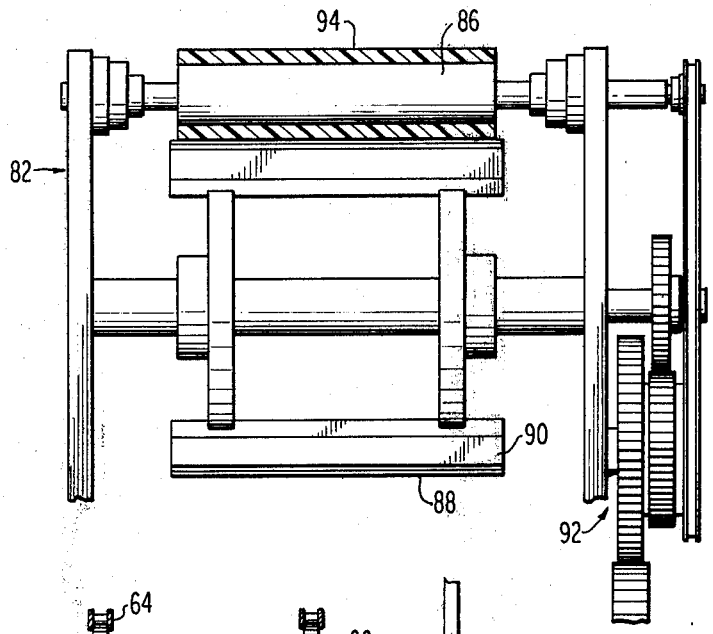
FIG. 7 is a sectional elevation view taken along line 7—7 of FIG. 3 showing web cutting means.

Following the application of the heat seal across spaced portions of the gusseted web, the web is cut in synchronism with the sealing and closely adjacent each seal by cutting means 82, see FIG. 2. These cutting means include a rotary cutter knife 84 and a back-up roll 86 positioned on opposite sides of the gusseted web. The rotary cutter knife 84 carries replaceable razor blade strip knives 88 in knife blocks 90 on its periphery, see FIG. 7. A drive gear train 92 drives the rotary knife and the back-up roll 86 at the same speed. The back-up roll 86 has a replaceable soft polyurethane coating 94 into which the razor blade knives 88 cut. The arrangement is such that it overcomes a very difficult and basic problem encountered in cutting webs of HDPE 2 to 3 mils thick, namely that of the cut surfaces sticking together after cutting so that the web cannot be easily opened. With the cutting arrangement shown in FIG. 7, the web is easily openable and such opening is necessary prior to the folding step so that the upper gusset edge can be gripped. In other words, in order to fold the bottom of the sealed gusseted sack to the shape shown in FIG. 14, the sack must be opened slightly.

Figure 3:
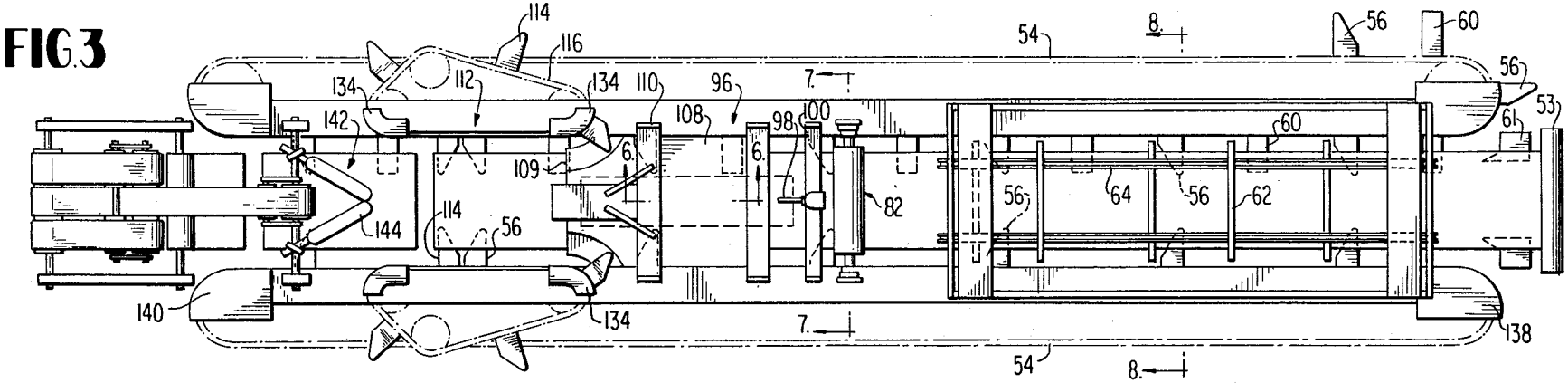
FIG. 3 is a top plan view of the machine shown in FIG. 2.

The opening step is accomplished at an airing station 96, see FIG. 3. The airing station includes an air nozzle 98, FIG. 6, supported from a transverse support 100 and connected to a suitable source of air under pressure. The tip of the air nozzle is directed toward the open end of the sack which has just been cut and blows onto this end in order to open the sack for subsequent bottom folding. Various means may be used to assist in the aeration of the sack e.g. the bottom surface of the gusseted web GW may be held down by a second set of rectangularly shaped lower gusset grippers (not shown) or by vacuum means including a vacuum box 102, FIG. 6, connected to a source of vacuum through line 104, over the top of which travels a perforated belt 106 driven by synchronized drive means at the speed of the web carrying chains 54.

Figure 6:
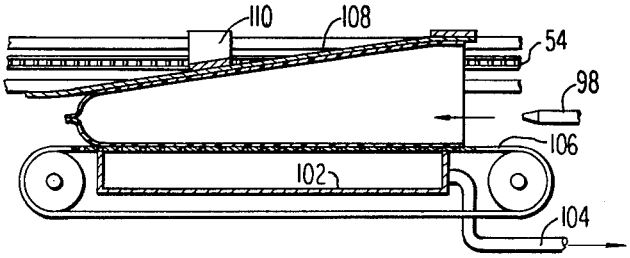
FIG. 6 is a sectional elevation view taken along line 6—6 of FIG. 3 showing sack airing means.

In order to control the opening of the bags to a predetermined amount and have each bag open the same amount, there is positioned a limiter plate 108 at an angle which is shown in FIG. 6, which limiter plate is supported from transverse supports 110. When leaving the airing station 106, the bags have been opened an amount equal to the distance that the trailing edge 109 of the limiter plate 108 extend above the web line. (In an alternative embodiment, the airing station may take place within the following zone, or as the first and second grippers have engaged the web, in which event these members effect the desired limiting action directly).

The aired and slightly open sealed but unfolded sack then enters the bottom folding station 42 where the upper gusseted edge GEU is gripped by upper gripper assemblies 112. FIGS. 2 and 3, positioned on each side of the web, particularly by travelling grippers 114 carried by chains 116 travelling around sprockets 118, see FIGS. 3 and 4. The trailing edges 109 of the limiter plate 108 positions the upper gusset edge GEU and guides the grippers 114 into position to grip this gusset edge.

Figure 4:
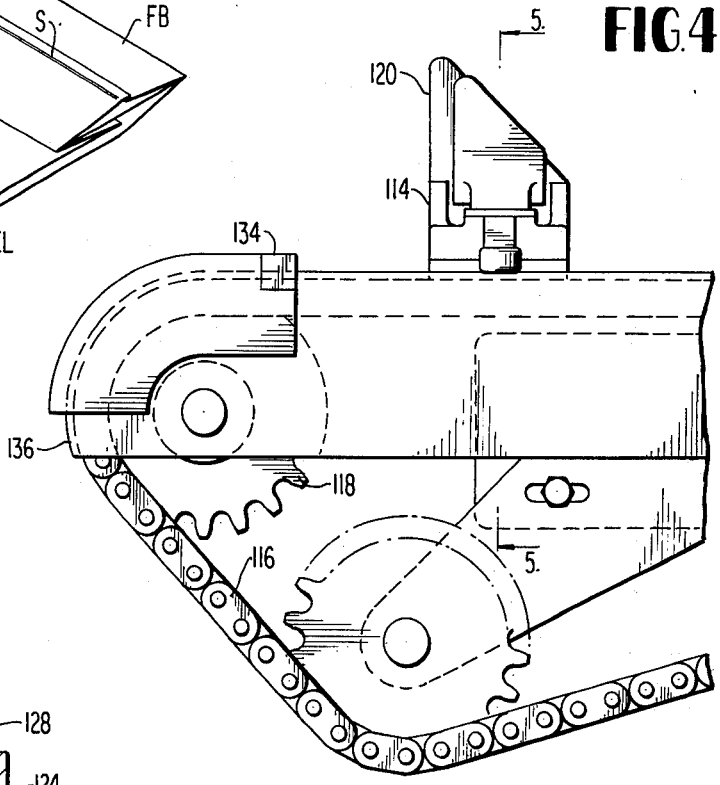
FIG. 4 is a detail top plan view of a portion of an upper gusset gripper assembly.
Figure 5:
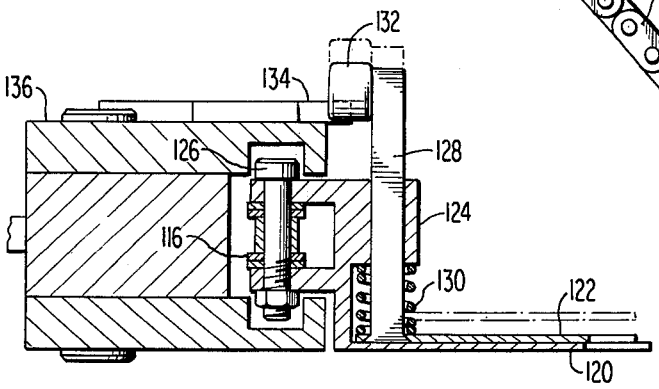
FIG. 5 is a sectional elevation view taken along lines 5—5 of FIG. 4 through an individual gripper.

The details of the grippers 114 are shown in FIGS. 4 and 5 and they can be essentially identical in outline to the grippers 56 for the lower gusseted edge, except that they are turned over, i.e. positioned reversely. The lower grippers 56 shown in FIG. 15 may also be fitted with a spacer 162 to open up the gusset so that the upper grippers 114 can properly clamp on to the top portion of the gusset. The upper and lower grippers each comprise a gripper clamp base and a movable clamp foot. Grippers 114 shown in FIGS. 4 and 5 includes a gripper clamp base 120 and a movable clamp foot 122 movable to phantom lines as shown in FIG. 5 for allowing the gripper to open in order that only the clamp base 120 may pass into the gusset of the web and then the clamp foot 122 may close on the outer surface of the gusset to grip the gusset edge and carry it along. The clamp base 120 is a portion of a member 124 which is secured to the chain 116 by suitable pins 126. The movable gripper clamp foot 122 is attached to a cam follower rod 128 vertically reciprocable in member 124 and biased into clamping position by a spring 130. A cam follower roller 132 is journalled on the end of cam follower rod 128 and is positioned to contact a stationary cam 134 on housing 136 at the position where the grippers must open for entering or leaving the gusset. In other words, there is a stationary cam 134 on housing 136 for the upper gripper assemblies 112 at both ends of where the grippers enter and then leave the web line as shown in FIG. 3. Similarly, but not shown, there are stationary cams on the surfaces of housing 138 and 140 around the sprockets for chains 54 to cam open the grippers 56 which grip the lower gusseted edge GEL. The movable and base clamp of the lower grippers 56 can be identical in outline to those of the upper grippers 114. As shown in FIG. 15, the lower grippers 56 can comprise base clamp 120 and movable clamp 176 which also serves to support the sack end seal S.

Figure 13:
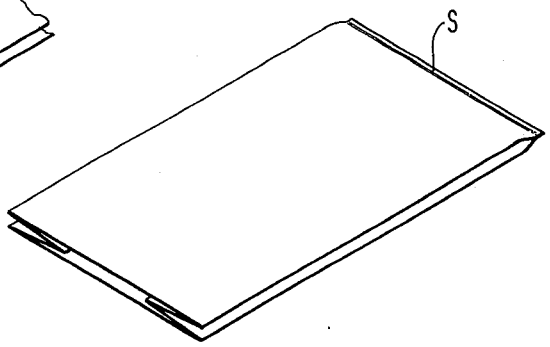
Figure 14:
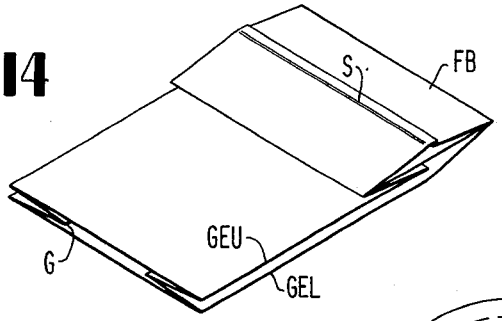
Figure 9:
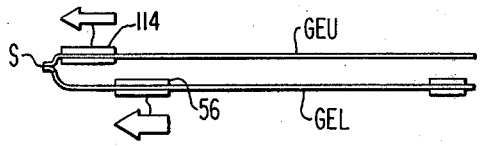
FIGS. 9, 10 and 11 are diagrammatic views illustrating schematically the progressive rough folding of the bottom fold in the gusseted sack by means of travelling sets of grippers moving at differential speeds.
Figure 10:
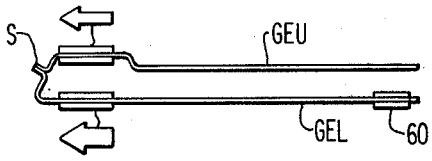
Figure 11:
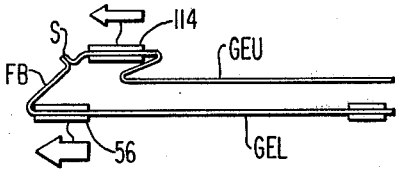

FIGS. 9, 10 and 11 show schematically how the two sets of grippers 56 and 114 grip and fold the bottom of the sack shown in FIG. 13 to provide the folded bottom shown in FIG. 14. First of all, the chains 116 for the upper gripper assemblies 112 are driven at a slower speed than the chains 54 carrying the lower grippers 56. This differential in speed is indicated by the size of the arrows in FIGS. 9–11, i.e. the lower grippers 56 travel the fastest. The chains are synchronized so that the grippers 56 and 114 grip the upper and lower gusseted edges in the positions shown in FIGS. 3 and 9, with the upper grippers 114 being the leading grippers and gripping adjacent the seal S while the grippers 56 follow and grip at a position adjacent the desired fold line. With the grippers gripping their respective edges as shown in FIG. 9, the differential speeds cause the upper grippers 114 to lag behind the lower grippers 56 as shown in the progression from FIGS. 9 to 11. (Alternatively, the differential speeds of the grippers may be such as to cause the lower grippers 56 to lag behind the upper grippers 114.) Not only do the upper grippers lag behind in velocity, they also move upwardly relative to the plane of the web as shown in FIGS. 9–11, due to the inclined mounting of the gripper assembly 112, FIG. 2.

This movement opens up and folds over the bottom of the bag to create a rough folded bottom FB. In other words, the fold is there but is not pressed down as the bag still contains some air from the airing station and HDPE does not fold in the same manner that Kraft paper folds.

The lower grippers may be suitably equipped with ancillary crease forming means 160 shown in FIGS. 15, 16 and 17 which trails the lower gripper, engaging the exterior of the upper gusset behind the upper gripper and pulling a portion of the web forwardly and below the rough folded bottom FB.

The ancillary crease forming means 160 is hingedly mounted on the undersurface of gripper clamp base 120 by bracket 172 and is actuated by a bellcrank assembly comprised of spring-biased bolt 166, bellcrank 164 pivoted about pivot pin 168 and bolted to bracket 172 by linkage 170. Cam follower roller 174 is journaled on the end of bellcrank 172 and positioned to contact a stationary cam (not shown) to effect opening and closing of the crease forming means 160. The crease forming means 160 is mounted so that in the open position, it extends above the upper gusset and in the closed position engages the upper surface of the upper gusset. The crease forming means 160 can be conveniently activated to close simultaneous with the lower gripper means 56.

It will be understood that it is geometrically necessary in order to form a so-called square bottomed bag that the grasping action be applied by the lower grippers at a point removed from the sealed bag extremity by a distance equal to the inlay dimension of the gusset to permit the requisite folding action to occur; whereas the upper grippers may grasp the upper portion of the gusset at points adjacent the sealed extremity and within a distance equal to the inlay dimension of the gusset. In other words, the upper grippers grasp the web at a point common with the lower grippers or forwardly thereof, preferably at a point in juxtaposition with the sealed extremity. Further, that in the event the apparatus is operated in a manner such that the sealed extremity of the sacks forms the trailing portion of the sack, the upper grippers will be caused to proceed at a faster rate than the lower grippers.

It will be seen that to facilitate the formation of regular, uniform folds the upper and lower grippers, respectively, are each formed in an angulated manner, i.e. the base clamp portion inserted into the gusset is truncated in the upper grippers at the trailing portion, as shown in FIG. 4 and in the lower grippers at the leading portion as shown in FIG. 15. Preferably, the cross-section is triangular in nature and ordinarily a 45 degree triangle, with the perpendicular portion leading in the upper grippers and trailing in the lower grippers.

Following the bottom folding station, there is a deairing means 142, FIG. 3, which in the embodiment shown, is a pair of brushes 144 positioned in a V with the apex of the V leading into the center of the folded bottom. These brushes press on the rough folded bottom bag and deair it.

Following the deairing means 142, there is a folded bottom pressing means 146, FIG. 2. This pressing means includes a center pressing belt 148 trained over suitable rollers 150 and positioned in the center of the folded bottom bag and a pair of edge pressing belts 152 trained over rollers 154 and positioned along the edges of the folded bottom bag above the gussets. These belts are driven at a speed faster than the speed of the chains 54 so the bags are taken away from the bottom folding station at a speed faster than they are folded and are quickly removed from the grippers as the lower grippers 54 are opened passing around the end sprockets. The folded bottom pressed bags are now complete and are delivered to the stacker-collater 44 for stacking and collating whereafter they are passed to the wrapping and shipping station 46 for bundling and palletizing for shipment to grocery stores or the like.

A machine constructed in accordance with this invention has successfully formed 1/6 bl grocery sacks of 3 mil HDPE with printing thereon at speeds well over 200 sacks/minute.

While the machine has been described for making standard size, folded bottom, grocery sacks of HDPE, it is obvious that its principles could be used to form similar bags of different sizes and that any suitably stiff thermoplastic material could be utilized instead of HDPE. The terms bag or sack are employed interchangeably herein without reference to differentiation in any trade usuage based upon size.

What we claim is:

1. In an apparatus for forming bags from a tubular web of plastic material having gussets formed from a centrally inlaid portion of said web at each lateral terminus thereof including means for transporting said web in a plane common to the lower gusseted portion thereof, means for sealing and cutting said web into predetermined lengths sealed at one end thereof and means for forming the bag base, the improvement comprising first and second gripper means for gripping the lower and upper gusseted portions of said web respectively, the first gripper being engageable with the lower gusseted portion of the web at a distance from the sealed end thereof approximately equal to the gusset depth and the second gripper means being engageable with the upper gusseted portion adjacent the sealed end within said distance; first and second conveying means for carrying said first and second gripper means, said first and second gripper means traveling in the same direction as said web, one of said gripper means traveling at the same speed as the web, and the other gripper means at slower speed so that the bag bottom is roughly formed and folded whereupon the slower speed gripper means are released.

2. Apparatus as in claim 1 wherein at least one of said gripper means engage the full depth of the gusset.

3. Apparatus as in claim 1 wherein the first gripper means travels at the same speed as the web.

4. Apparatus as in claim 1 further including web-inflating means for directing a jet of air at the open end of the cut web, prior to the bag bottom folding and forming, for flexing the lower and upper gusseted portion of the web.

5. Apparatus as in claim 4 further including bag deflating means following folding and forming, and pressing means for flattening the deflated bag.

6. Apparatus as in claim 1 wherein each gripper means includes at least one set of individually openable and closeable traveling grippers mounted for movement along both sides of the path of the web.

7. Apparatus as in claim 1 including gripper guide and gusset opening means for opening the gussets of the web and guiding the first gripper means into the open gusset.

8. Apparatus as in claim 7 wherein said gripper guide and gusset opening means guide one portion of the gripper into the gusset and another portion of the gripper below the web.

9. Apparatus as in claim 1 wherein said first gripper means comprises spacer means to open said gusset for engagement of the upper gusset by the second gripper means.

10. Apparatus as in claim 9 wherein said first gripper means comprises trailing crease-forming means disposed exteriorly of the upper gusset.

11. Apparatus as in claim 1 wherein the first gripper and the second gripper engage the lower and upper gussets respectively each at a distance from the sealed extremity approximately equal to the gusset depth.

12. In a process for forming bags with folded bottoms therein from a gusseted flattened tubular web of thermoplastic material wherein said web is fed through a zone in which it is transversely sealed at spaced locations and severed adjacent the sealed portions to form a series of longitudinally disposed bag blanks, one extremity thereof being sealed, and a bag bottom formed from said sealed bag extremity, the improvement which comprises separately engaging the upper and lower gusset portions of the web at spaced points on each side of the web adjacent the sealed extremity thereof, causing the upper and lower gusset portions to move at a differential longitudinal speed relative to one another in the same direction so as to form directly a roughly folded bottom therein, and releasing the bag, whereby such process may be continuously and repetitively operated at high speed to produce a multiplicity of bags sequentially.

13. The process of claim 12 wherein the lower gusset is engaged at a distance from the sealed extremity approximately equal to the gusset depth, and the upper gusset is engaged at a point within said distance.

14. The process of claim 13 wherein the lower and upper gussets are engaged at a distance from the sealed extremity approximately equal to the gusset depth.

15. The process of claim 12 wherein prior to engaging said web for folding, the bag blank is at least partially flexed to render it more readily susceptible to the folding operation.

16. The process of claim 15 wherein the bag is flexed by airing means.

17. The process of claim 12 wherein the gusset portions are caused to move in planes spaced from one another, the planes being adjacent to and generally parallel with the plane of the unengaged bag blank.

18. A process for forming a bag with a folded bottom comprising providing a bag blank being a discrete segment of a gusseted flattened tubular web of thermoplastic material having one end transversely sealed at a folding station; releasably grasping the upper and lower gusset portions of the bag blank at spaced points on each side of the bag blank adjacent the sealed end thereof while forwarding said bag blank through said folding station, said upper gusset portions of each side of said bag blank being commonly forwarded in the same direction at a speed different from that of said lower gusset portions causing lateral folds to form in each face of said bag blank and the gusset portions adjacent the grasping region defining a bag bottom.

19. A process for forming a bag with a folded bottom comprising:

providing a web of flattened tubular thermoplastic material having top and bottom faces united along each longitudinal edge by an inlaid folded gusset;

sealing said web transversely at spaced locations;

severing said web adjacent and forwardly of the sealed portions to form a series of discrete bag blanks, the leading extremity thereof being sealed;

releasably grasping the bottom portion of each edge of each of said bag blanks, sequentially, at common points a distance from the sealed extremity approximately equal to the gusset depth and transporting said bag blanks thereby into a folding zone at a first speed;

releasably grasping the upper portion of each edge of each of said bag blanks, sequentially, at common points directly adjacent the sealed end thereof, and forwarding said upper portion of said bag blanks at a second speed slower than said first speed, whereby rough transverse folds are caused to form in each face of said bag blank and the gusset portions adjacent the grasping region defining a rough bag bottom therein;

releasing said upper portion of each of said blanks, respectively;

transporting roughly folded bag blanks sequentially to a pressing station; and pressing said bag blanks respectively.

20. The process of claim 19 wherein the web in fully grasped condition is partially inflated prior to effecting the folding action.

21. A process of automatically and continuously making folded bottom gusseted grocery sacks at high speed from a travelling web of gusseted thermoplastic film, the process comprising:

a. controllably feeding the web to a sealing zone;

b. continuously sealing the moving web across the width of the web while heating it, the speed of the moving web during sealing being slightly less than the feeding speed so the seals are not torn apart;

c. cutting the web transversely in synchronism with and adjacent the seals to create individual sacks;

d. moving the individual sacks at the speed of the web though airing opening, bottom folding, and deairing zones;

e. blowing a controlled amount of air into the individual sacks as they move through the airing zone to open the sacks;

f. folding the bottom of the individual sacks as they move through the folding zone by gripping the upper side of the sack gusset and moving it at a slower speed from the bottom sack gusset;

g. removing the air from the individual rough folded bottom sacks as they move through the deairing zone;

h. taking away the individual folded bottom sacks from the deairing zone and simultaneously pressing the fold therein.

* * * * *